US008395329B2

(12) United States Patent
Jutras et al.

(10) Patent No.: US 8,395,329 B2
(45) Date of Patent: Mar. 12, 2013

(54) LED BALLAST POWER SUPPLY HAVING DIGITAL CONTROLLER

(75) Inventors: Mark Jutras, Upton, MA (US); Mark Masera, North Grafton, MA (US); Scott Moore, Westford, MA (US)

(73) Assignee: Bel Fuse (Macao Commercial Offshore), Andar H-K (MO)

( * ) Notice: Subject to any disclaimer, the term of this patent is extended or adjusted under 35 U.S.C. 154(b) by 197 days.

(21) Appl. No.: 12/868,965

(22) Filed: Aug. 26, 2010

(65) Prior Publication Data

US 2011/0057573 A1 Mar. 10, 2011

Related U.S. Application Data

(60) Provisional application No. 61/346,633, filed on May 20, 2010, provisional application No. 61/240,754, filed on Sep. 9, 2009.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 41/16*** | (2006.01) |
| ***H05B 41/24*** | (2006.01) |

(52) U.S. Cl. ..... 315/291; 315/307; 315/246; 363/21.15

(58) Field of Classification Search ..... 315/291, 315/307, 224, 247, 129, 209 R, 308, 246; 363/21, 21.15, 15

See application file for complete search history.

(56) References Cited

U.S. PATENT DOCUMENTS

| | | | | |
|---|---|---|---|---|
| 6,586,890 | B2 | 7/2003 | Min et al. | |
| 6,747,420 | B2 * | 6/2004 | Barth et al. | 315/291 |
| 7,202,608 | B2 * | 4/2007 | Robinson et al. | 315/224 |
| 7,262,559 | B2 * | 8/2007 | Tripathi et al. | 315/291 |
| 7,750,579 | B2 * | 7/2010 | Aiello | 315/247 |
| 8,049,427 | B2 * | 11/2011 | Altonen et al. | 315/129 |
| 8,115,419 | B2 * | 2/2012 | Given et al. | 315/307 |
| 8,134,304 | B2 * | 3/2012 | Hsu et al. | 315/291 |
| 2004/0251854 | A1 * | 12/2004 | Matsuda et al. | 315/291 |
| 2007/0182347 | A1 * | 8/2007 | Shteynberg et al. | 315/312 |
| 2011/0037407 | A1 * | 2/2011 | Ahn et al. | 315/287 |
| 2012/0153866 | A1 * | 6/2012 | Liu | 315/294 |
| 2012/0212143 | A1 * | 8/2012 | Esaki et al. | 315/192 |

FOREIGN PATENT DOCUMENTS

| | | | |
|---|---|---|---|
| WO | 2004057924 | A1 | 7/2004 |
| WO | 2006046207 | A1 | 5/2006 |
| WO | 2007071033 | A1 | 6/2007 |

* cited by examiner

*Primary Examiner* — Shawki Ismail
*Assistant Examiner* — Dylan White
(74) *Attorney, Agent, or Firm* — BainwoodHuang

(57) ABSTRACT

A power supply for an LED lamp has a set of coupled coils, primary-side power circuitry including a converter power switch for conducting input power, and secondary-side power circuitry including a dimming power switch. Power control circuitry includes converter control circuitry which generates a converter control signal for the converter power switch to maintain a desired undimmed level of lamp current at a normal operating value of a lamp voltage. Dimming control circuitry generates a dimming control signal for the dimming power switch to pulse-width modulate the lamp current at a duty cycle corresponding to a desired dimming. Operation of the converter control circuitry is modified during dimming to prevent an automatic increase of the lamp voltage in response to a decrease in lamp current, avoiding undesirable overshooting of the lamp current and providing more accurate and effective control over dimming operation.

15 Claims, 10 Drawing Sheets

LED BALLAST POWER SUPPLY HAVING DIGITAL CONTROLLER

BACKGROUND

The present invention is related to the field of power supplies or ballasts for relatively high-power LED lamps used for area lighting.

There is increasing use of high-power light-emitting diodes (LEDs) to construct light fixtures or lamps used for area lighting, replacing the more traditional incandescent or fluorescent types of lamps. LED-based lighting can provide several benefits including improved efficiency and greater control over both the physical packaging and the light output characteristics of light fixtures. As the light from a given LED is typically limited, LED lamps typically employ a number of LEDs operating together to achieve a desired light output. In one configuration, LEDs are connected together in series and a relatively high lamp voltage (generally proportional to the number of series-connected LEDs) is used. The light output of the lamp may be controlled by a lamp power supply that regulates lamp current to a desired level which corresponds to the normal operating light output of the lamp.

SUMMARY

It is common practice to provide a dimming function for LED lamps, for example by applying current pulses of a fixed amplitude at a controlled duty cycle to lower the average lamp current to a value corresponding to a desired dimmed level of lamp brightness. In typical applications the pulse frequency may be set to between 100 Hz and 1 KHz and the duty cycle varied from 10% to 100%. In some dimming applications it may be desired to control this duty cycle in increments tighter than 1%.

In one type of implementation, the current pulsing is achieved by use of a controlled power switch (such as a power FET device) in series with the LED lamp. Turning this switch on and off abruptly disengages and reengages the voltage applied across the lamp. The use of this switch allows fast delivery of the pulsed current to the lamp, but there are additional design considerations. When the switch is turned off, the lamp is disconnected from the power delivery circuit and no lamp current flows. This can cause the lamp current regulating circuit to temporarily drive lamp voltage very high in an attempt to increase lamp current back to the regulated level. When the dimming switch is subsequently switched back on, the high lamp voltage results in an undesirably high level of lamp current until the regulating circuitry brings it back to the regulated value. This temporary high level of lamp current may be referred to as "overshoot". The presence of significant overshoot may significantly limit the accuracy and resolution to which the light output of the lamp can be controlled using dimming. While it may be possible to use certain circuitry techniques, such as a conventional clamp circuit, to prevent such large excursions of the lamp voltage, such circuitry may dissipate power and result in lower efficiency.

In accordance with embodiments of the invention, a power supply is disclosed for an LED lamp of the type having a number of series-connected high-power light-emitting diodes. The power supply provides for accurate dimming without sacrificing efficiency in the manner of clamping and similar circuitry.

The power supply employs an isolating power-coupling device such as a transformer or set of coupled coils. Primary-side power circuitry includes a converter power switch in series with a primary-side coil for conducting input power based on a converter control signal supplied to the converter power switch, and secondary-side power circuitry includes a dimming power switch in series with the LED lamp and a second coil inductively coupled to the first coil for providing output power to the LED lamp based on a dimming control signal supplied to the dimming power switch. Power control circuitry includes converter control circuitry which has a normal operation by which it generates the converter control signal to maintain a desired undimmed level of lamp current in the LED lamp at a normal operating value of a lamp voltage of the LED lamp. Dimming control circuitry generates the dimming control signal to pulse-width modulate the lamp current at a duty cycle corresponding to a desired dimming of the LED lamp. At on-to-off transitions of the dimming control signal, operation of the converter control circuitry is modified to prevent an automatic increase of the lamp voltage in response to a decrease in lamp current, and at off-to-on transitions of the dimming control signal, normal operation of the converter control circuitry is restored. By this control regime, undesirable overshooting of the lamp current at the off-to-on transitions is avoided, providing more accurate and effective control over dimming operation.

In one type of embodiment, the converter control signal is generated so as to establish an on value of the lamp voltage which (a) maintains the desired level of lamp current in the LED lamp during non-dimmed operation, and (b) is less than a predetermined maximum lamp voltage represented by a first value of a voltage reference signal. The pulse-width modulating includes (i) during on times of the dimming control signal, sensing and storing the on value of the lamp voltage, (ii) immediately prior to the on-to-off transitions of the dimming control signal, setting the voltage reference signal to a second value representing the stored on value of the lamp voltage, and (iii) immediately prior to the off-to-on transitions of the dimming control signal, returning the voltage reference signal to the first value.

In an embodiment of this type, the control circuitry may be realized in a digital controller including analog-to-digital converters, a processor, and a PWM output. The analog-to-digital converters can be used to convert analog inputs representing the lamp voltage and the lamp current to corresponding digital values for processing by the processor, and the PWM output can carry a reference PWM signal having a duty cycle corresponding to a value of the voltage reference signal being set by the control circuitry.

In another type of embodiment, the power control circuitry may be implemented substantially as an integrated digital controller programmed with respective control routines to realize the converter control circuitry and the dimming control circuitry. A dimming control routine can include (1) at the on-to-off transitions of the dimming control signal, (a) waiting as necessary until the converter control signal becomes off, and (b) latching the converter control signal to prevent it from becoming on during a subsequent off time of the dimming control signal, and (2) at the off-to-on transitions of the dimming control signal, un-latching the converter control signal to resume normal operation of the converter control circuitry. This latter type of embodiment may provide for even greater accuracy as it avoids reliance on controlling reference values and limited response times of associated analog circuitry.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

The entire disclosure of U.S. provisional application 61/346,633 is incorporated by reference herein.

Figure 1:
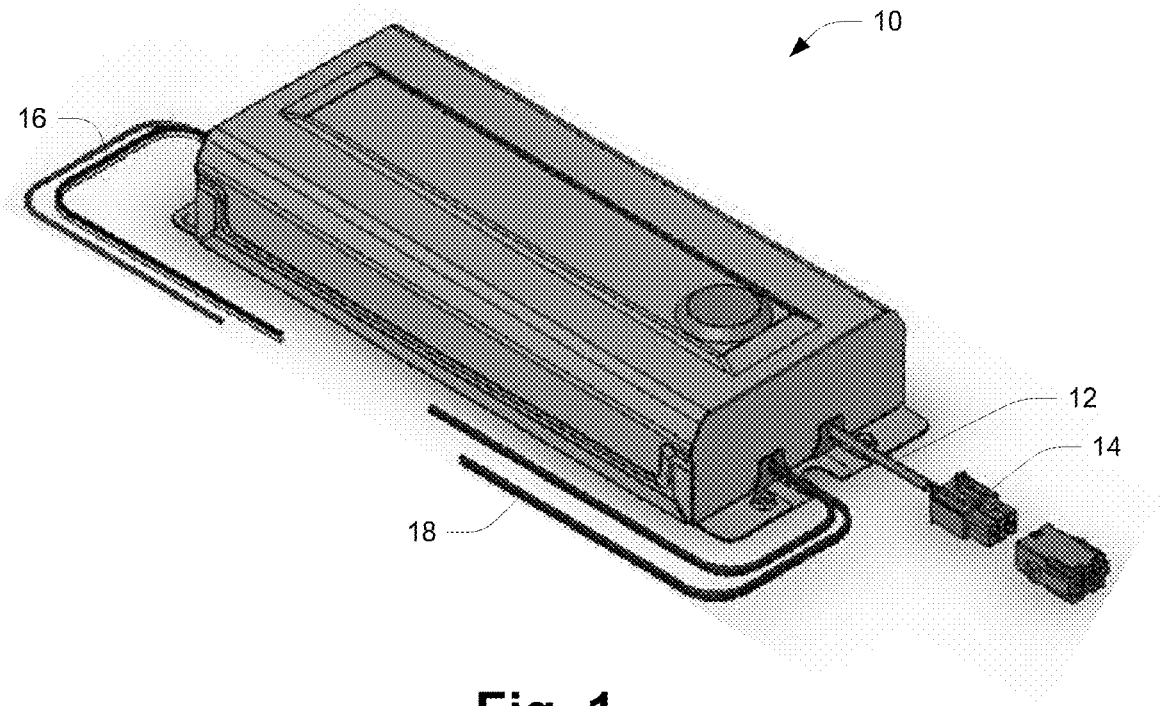
FIG. 1 is a perspective diagram of a physical package for an LED lamp power supply.

FIG. 1 depicts a mechanical design for a light emitting diode (LED) ballast or LED power supply 10 designed to connect to an AC mains and provide output to an LED lamp (not shown). An LED lamp typically consists of some number of white LEDs connected in series which make up a lamp assembly. The LED power supply 10 includes an interface cable 12 forming part of a communications interface used for communications between the LED power supply 10 and an external higher-level controller (not shown). The communications interface can be used, for example, for configuration of operating parameters, setting a mode of operation and for collecting operating data. Communications may be bi-directional and may utilize a so-called "master-slave" arrangement in which the LED power supply 10 is configured as a slave. The interface cable 12 is shown on the right hand side with a connector 14 attached. The LED power supply 10 also has wires 16 on the left that are used to connect to the AC mains, and two sets of output wires 18 on the right that connect to a pair of LED lamp assemblies. In alternative embodiments, some other number (including one) of output connections may be provided.

The LED power supply 10 receives input power from an AC source, usually provided by a power utility, and provides one or more outputs each of which powers an LED lamp having a string of LEDs. Each LED lamp may be driven with a fixed drive current, for example in the range of 350 mA to 750 mA, and a resultant lamp voltage (e.g., in the range of 60 V DC to 120 V DC) appears across the LED lamp. For normal (undimmed) operation, the lamp current is constant and the main factor determining the voltage drop across the LED lamp is the number of LEDs connected in series in the lamp.

One of the advantages of LED lighting is ease of control when compared to other lamp technologies available. Described herein are new control methods developed to improve the performance of these control functions with the use of digital control elements added to the design.

Figure 2:
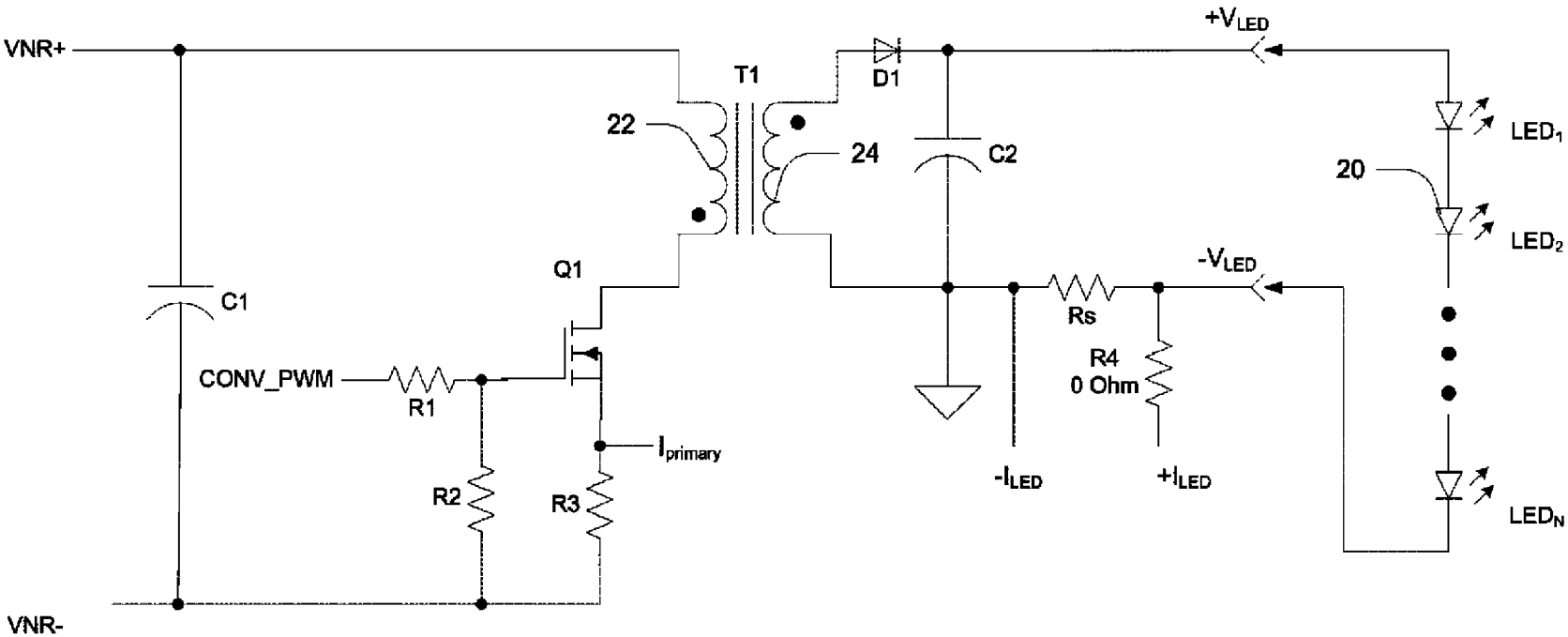
FIG. 2 is a schematic diagram of a converter circuit for an LED lamp power supply.

FIG. 2 is a functional schematic of a power conversion circuit used to provide power to an LED lamp. The topology in FIG. 2 is a flyback converter, but other power conversion topologies can be used. The selected topology should be capable of producing an output voltage as required to produce the desired forward current through the LED lamp. In the flyback topology of FIG. 2, power input is provided at the nodes labeled VNR+ and VNR−. The voltage VNR is a "non-regulated" DC voltage that may be generated from an AC mains. Rectifying the AC input with a diode bridge in combination with a hold up capacitor is one method of generating this VNR voltage. Alternatively, a more sophisticated processing technique could be used to achieve improved power factor (e.g., near unity), as generally known in the art. For the purpose of this description the voltage across the VNR+ to VNR− is considered as a reasonably stable DC source. The DC voltage may be in the range of 120V to 400V if derived from simple rectification, or it may be approximately 400V if derived using a method providing near unity power factor. Other delivered voltages can also be accepted depending on the design of the LED power interface.

Referring to FIG. 2, the power interface is designed to convert the DC input at VNR+, VNR−, to a DC output that maintains a lamp current through LEDs 20 at a constant value. The lamp current is determined by the lamp voltage ($+V_{LED}-(-V_{LED})$) applied to the lamp as well as the characteristics of the LEDs 20. This voltage will be set by a separate control circuit (not shown in FIG. 2) to maintain a constant value of the lamp current through the LED string. As shown, a sense resistor Rs may be used to generate signals $+I_{LED}$ and $-I_{LED}$ indicative of the level of lamp current, which can be used as a feedback signal to control the lamp current (described in more detail below). A converter control signal CONV_PWM is a rectangular pulse of fixed amplitude that is generated by a control circuit (described below) and is delivered to the gate of a converter power switch Q1 through a resistor R1. The width of this pulse and the frequency of the pulse train determines the amount of power delivered to the lamp. It should be noted that the signal CONV_PWM is one of multiple PWM signals described herein which are used for distinct purposes. The CONV_PWM signal relates solely to the control of the power processed by the LED power interface circuitry shown in FIG. 2.

The circuit of FIG. 2 includes a pair of coupled inductors referred to collectively by the label T1. When Q1 is commanded on by the CONV_PWM signal, the VNR voltage appears across a primary-side coil 22 of T1. The coil 22 is wound in a direction opposite to that of a secondary-side coil 24, so that an output diode D1 is reverse biased when the VNR voltage is applied across the primary-side coil 22. With voltage applied across the primary-side coil, energy is stored in a magnetizing inductance of the coupled coils 22, 24 as the current increases over time. When Q1 is turned off, the current path on the primary-side coil 22 is interrupted and a flyback action causes a current to flow out of the secondary-side coil 24 in the direction that forwarded biases diode D1, delivering energy to the LED lamp. This process is repeated continually at the pulse frequency of the CONV_PWM signal to produce the output power to power the LEDs 20. A filter capacitor C2 provides filtering so that the lamp voltage across the LED lamp is reasonably constant and exhibits only an acceptable level of ripple.

The average lamp current delivered to the LED lamp can be controlled by adjusting a timing aspect (i.e., duty cycle and/or frequency) of the CONV_PWM signal. In the illustrated embodiment it is assumed that the duty cycle of the CONV_PWM signal is varied by a control circuit based on a controlled parameter, which may be either a lamp voltage across the LED lamp or the lamp current delivered to the LED lamp as measured across Rs.

Figure 3:
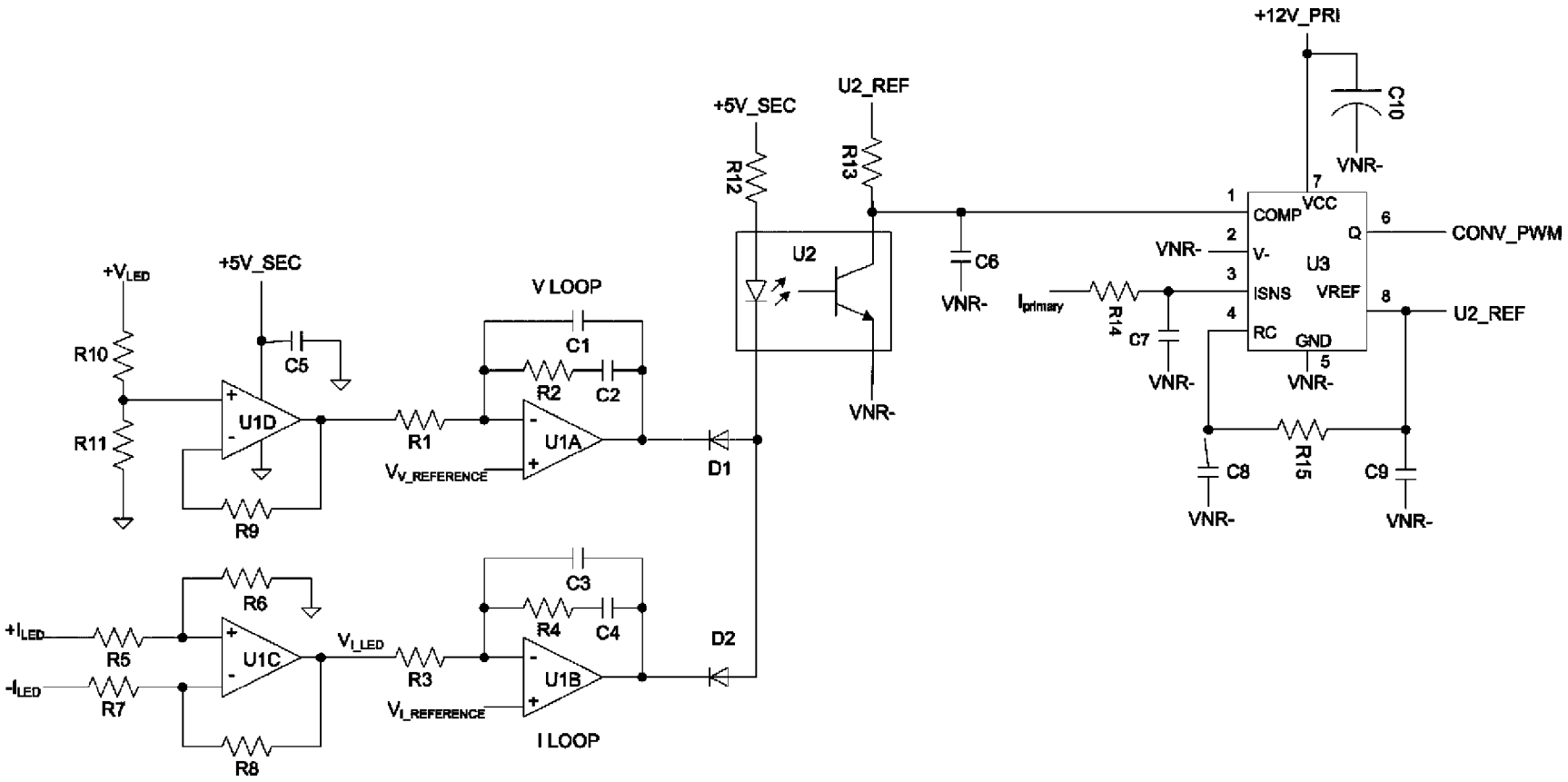
FIG. 3 is a schematic diagram of control circuitry for an LED lamp power supply including current-control and voltage-control circuitry.

FIG. 3 shows a dual loop control circuit used to generate the CONV_PWM signal that controls the flyback converter of FIG. 2. The control circuit of FIG. 3 generates two possible control signals that are coupled through an opto-coupler U2 to a PWM control circuit U3. In one embodiment, U3 is a PWM controller integrated circuit that responds to a control input COMP to adjust the duty cycle of a pulse output Q. A commercially available IC suitable for use as U3 is a Texas Instruments TL2843. Also shown in FIG. 3 are four operation amplifiers U1A-U1D which buffer the signals $V_{LED}$ and $I_{LED}$ and then compare these to respective reference signals $V_{V_REFERENCE}$ and $V_{I_REFERENCE}$. The operation amplifiers U1A-U1D may be realized as a single quad-amplifier device such as Microchip MCP6004. This circuit is designed to regulate lamp current if the sensed lamp current as represented by $I_{LED}$ reaches a reference current represented by $V_{I_REFERENCE}$ (current loop) or if the sensed lamp voltage $V_{LED}$ reaches a reference voltage represented by a separate value $V_{V_REFERENCE}$ (voltage loop). If the current loop is in control it adjusts the LED current of U2 through a diode D2 and a resistor R12. If the voltage loop is in control it adjusts the LED current of U2 through a diode D1 and the resistor R12. In normal operation, the lamp current is controlled to a desired level by the current loop. The voltage loop is provided to limit the lamp voltage to less than a predetermined maximum lamp voltage to prevent damage, for example if the lamp is open circuit due to a fault. For this operation, the value of $V_{V_REFERENCE}$ corresponds to this predetermined maximum lamp voltage.

In FIG. 3, the op-amp U1B is the current loop error amplifier and the signal $V_{I_REFERENCE}$ is the reference that determines the lamp current when the current loop is engaged. When engaged, the current loop controls the duty cycle of the CONV_PWM signal to provide a constant average lamp current proportional to the value of $V_{I_REFERENCE}$.

U1A is the voltage loop error amplifier and the signal $V_{V_REFERENCE}$ is the reference that determines the lamp voltage across the lamp connections when the voltage loop is engaged. When engaged, the voltage loop controls the duty cycle of the CONV_PWM signal to provide a fixed lamp voltage across the lamp terminals proportional to the value of $V_{V_REFERENCE}$.

When controlling current the CONV_PWM signal delivered as a result of the current loop adjusts the voltage across the lamp as necessary to maintain the desired lamp current as represented by the associated reference value $V_{I_REFERENCE}$. If a lamp voltage in excess of that determined by the value of $V_{V_REFERENCE}$ is required to achieve the target lamp current, then the voltage loop asserts control and limits the applied lamp voltage accordingly.

The control circuit of FIG. 3 is an example of converter control circuitry that constitutes part of a collection of power control circuitry of an LED lamp power supply. As described below, dimming control circuitry is also included to provide a lamp dimming function.

Figure 4A:
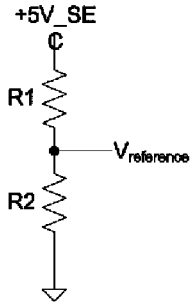
FIGS. 4A and 4B are schematic diagrams of analog circuits for generating a reference signal.
Figure 4B:
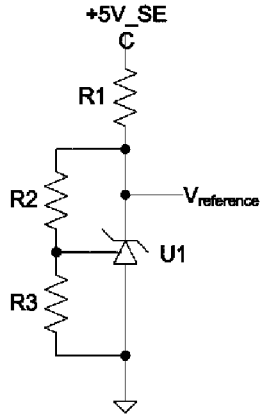

FIGS. 4A and 4B show two alternative ways of establishing a reference voltage shown as $V_{reference}$. FIG. 4A is a simple voltage divider from a fixed DC source. FIG. 4B is more accurate and uses a voltage reference IC, U1, to derive a fixed reference from a DC source.

If it is desired for the reference voltages to be adjustable (e.g., through a control interface), there are a variety of possible approaches. In the circuit of FIG. 4A, the resistor R2 could be replaced with a digital potentiometer (digi-pot) that is controlled by a microcontroller. The same result could be achieved by placing a digi-pot at the location of R3 in the circuit of FIG. 4B. In another approach, a digital to analog converter (DAC) can be used which is controlled by a microcontroller. Disadvantages of these approaches include relatively low resolution, high cost and space utilization. For example, a digi-pot is typically limited to 64 taps, and even a small (8-bit) DAC can occupy significant space, resulting in a more costly and larger control IC.

Figure 5:
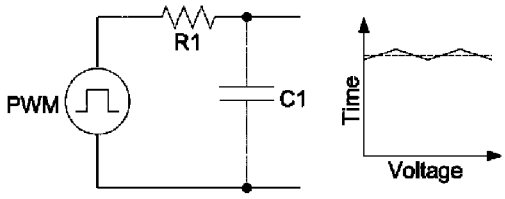
FIG. 5 is a schematic diagram and signal plot for a pulse-width-modulation (PWM) technique for generating a reference signal.

Microcontrollers and digital signal processors are available that include digital PWM outputs that typically have from 8 to 12 bits of control with a very low price premium for the feature. If a controllable reference is needed, then using a PWM output from one of these devices is a cost effective way to achieve this function. FIG. 5 shows an approach in which a PWM signal is filtered with an RC network to produce a near DC signal that is stable enough to be used as a reference (it should be noted that this is a second use of a PWM signal, distinct from the control signal CONV_PWM described above). Providing a reference in this manner allows the reference to be easily set through firmware commands executed by the host microcontroller. The advantages of using such a PWM signal to generate a reference include:

1) If the microcontroller contains a communications interface the software can be written to set these values remotely.

2) The resulting controlled outputs from the power conversion stage can be made more accurate through calibration.

3) The values can be easily adjusted through firmware commands to optimize performance under conditions that can be monitored by the microcontroller device.

4) Using PWM generated reference signals allow the cost effective use of digital controls as a means to implement performance improvements.

Figure 6:
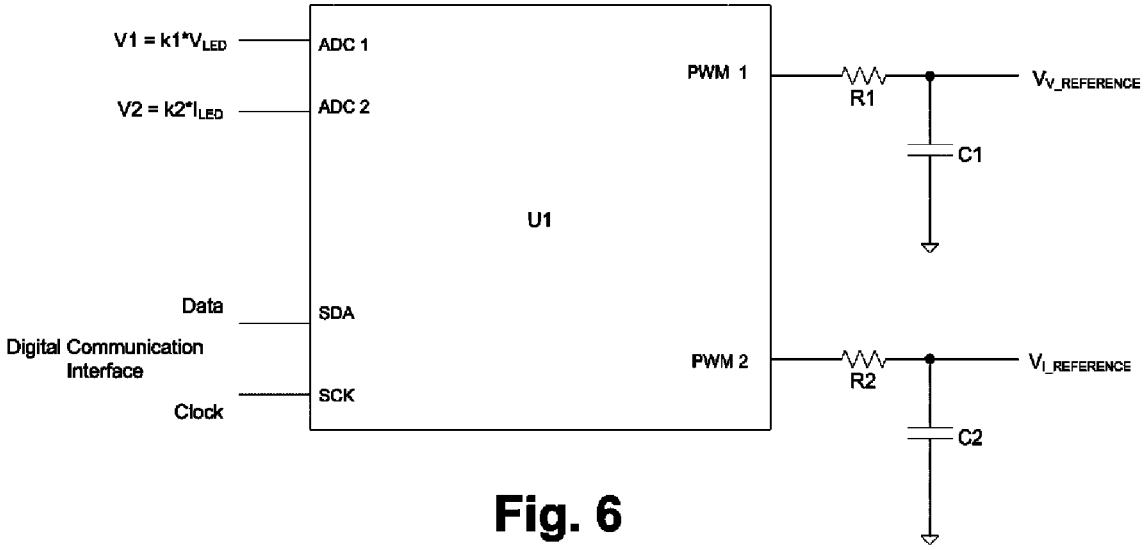
FIG. 6 is a schematic diagram showing use of an integrated digital PWM controller used as part of a power control circuit.

FIG. 6 shows a microcontroller or digital signal processor U1 that has at least two analog to digital conversion (ADC) inputs, a serial communications interface, and at least two digital PWM outputs. There are a variety of commercially available devices and suppliers including Microchip, Texas Instruments, Atmel, and Freescale. Using such a device as shown in FIG. 6 allows the implementation of a PWM controlled reference with the ability to implement the features described above.

It is possible to provide a dimming function for LED lamps by either reducing the DC lamp current or by applying fixed-amplitude current pulses with a controlled duty cycle to lower the average current delivered to the lamp assembly. The former is simple but results in diminished light quality at lower applied currents. The latter requires a more complicated implementation but maintains the quality of the light color at reduced intensity. A version of the controlled duty cycle or PWM method is described herein. This is the third independent use of a PWM signal, distinct from the converter control CONV_PWM and the PWM references described above. This PWM is referred to as the DIM_PWM. In a typical application, the pulse frequency of the DIM_PWM signal is in a range from 100 Hz and 1 KHz and has a duty cycle varying over the range from 10% to 100%. In some dimming applications it is desired to control this duty cycle in increments of 1% or less.

It would be possible to employ one of the following two techniques for delivering a pulsed current to an LED lamp with a controlled duty cycle:

1) Turning the power interface on and off with a control signal while keeping the current reference value fixed.

2) Applying a rectangular series of pulses to the current reference with an amplitude that determines the applied current and a duty cycle that achieves the desired dimming.

Figure 7:
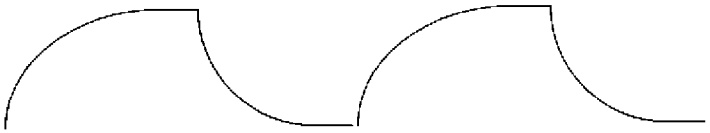
FIG. 7 is a waveform diagram of pulsed lamp current under certain operating conditions.

If either of the above methods is used, then certain circuit characteristics such as the response time of the control loop, the energy contained in the energy storage elements, and replenishing energy in the energy storage elements can affect operation. As the frequency of the dimming PWM signal increases, the resulting current delivered to the LED lamp may begin to take the distorted shape shown in FIG. 7. Thus there may be frequency limitations on the PWM dimming control as well as loss of fine dimming resolution. It is desired to maintain the frequency of the dimming PWM sufficiently high so as to not be noticed by the human eye. Lower frequencies can result in an effect commonly referred to as flicker. In some applications of ambient lighting, more precise control of the light intensity may also be desired. Both of these are considerations in determining whether either of the above control methods are feasible.

Significant improvements to the pulse shape can be achieved by using a third technique, which is the use of a switch in series with the LED lamp which is controlled by the DIM_PWM signal. Turning this switch on and off abruptly disengage and reengage the lamp voltage applied across the LED lamp, providing faster and cleaner delivery of the pulsed current to the lamp and avoiding the type of distortion illustrated in FIG. 7.

Figure 8:
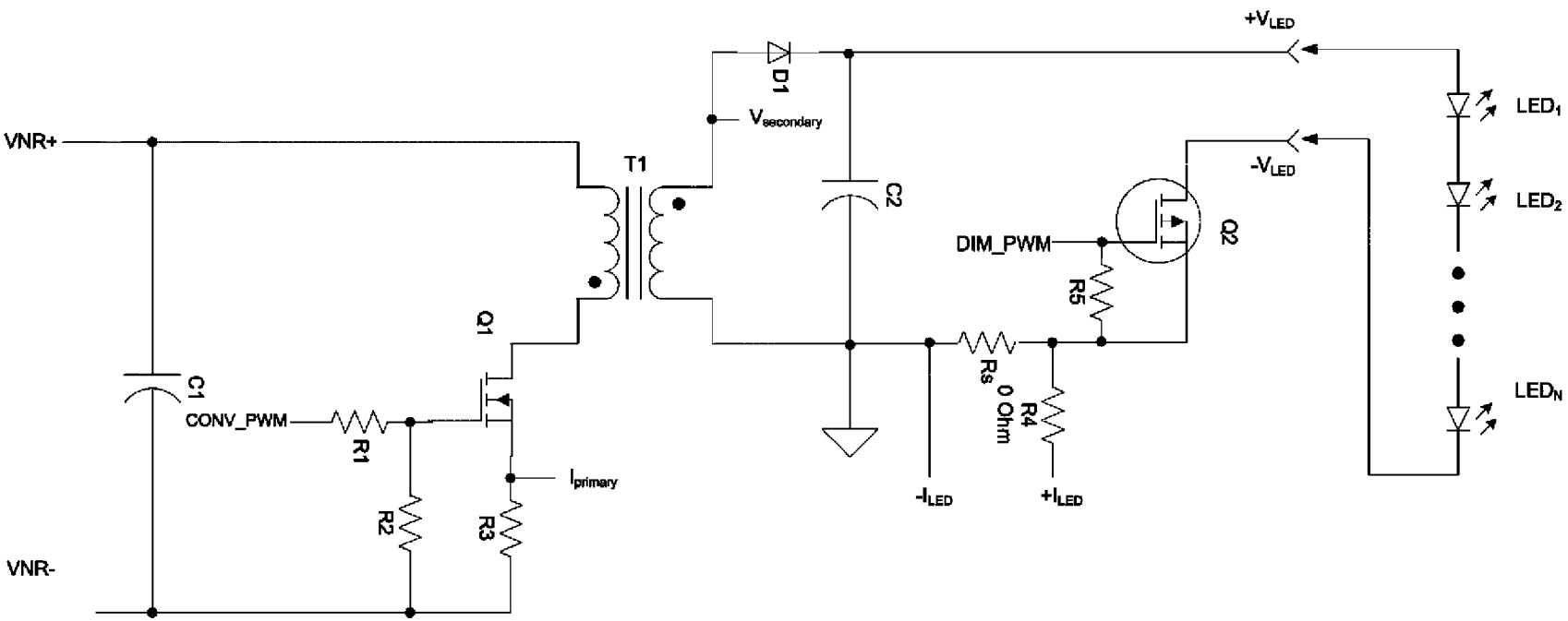
FIG. 8 is a schematic diagram of a converter circuitry with dimming for an LED lamp power supply.

FIG. 8 shows a power circuit which employs such a dimming power switch (shown as Q2) in series with the LED lamp. Lamp current only flows when the switch Q2 is on, as controlled by an ON level of DIM_PWM. Dimming is achieved by modulating the pulse width of the DIM_PWM signal, with higher duty cycle providing brighter light output and lower duty cycle providing dimmer light output.

One potential problem with the approach of FIG. 8 is a possible effect of the current control loop as described above. When Q2 is turned off (by de-assertion of the DIM_PWM signal), the lamp is disconnected from the power delivery circuit and no lamp current flows. This condition is signaled as a corresponding reduction in the feedback signal $I_{LED}$ to the current control loop of FIG. 3. The current control loop tends to respond by commanding the lamp voltage (voltage across C2) to increase in an attempt to maintain the desired current represented by $V_{I_REFERENCE}$. As a result, while Q2 is off the lamp voltage tends to increase and may become sufficiently high to cause the voltage control loop to assert control and maintain the value set by the voltage loop reference $V_{I_REFERENCE}$. When Q2 is turned back on, the lamp voltage is much higher than needed for the desired lamp current, and a large overshoot in the lamp current will occur. This excessive current will exist until the current loop is able to respond and the excessive energy is bled from C2. It would be possible to address this situation by applying a clamp circuit across C2, for example, but such techniques generally dissipate power and thus lower overall efficiency.

Figure 9:
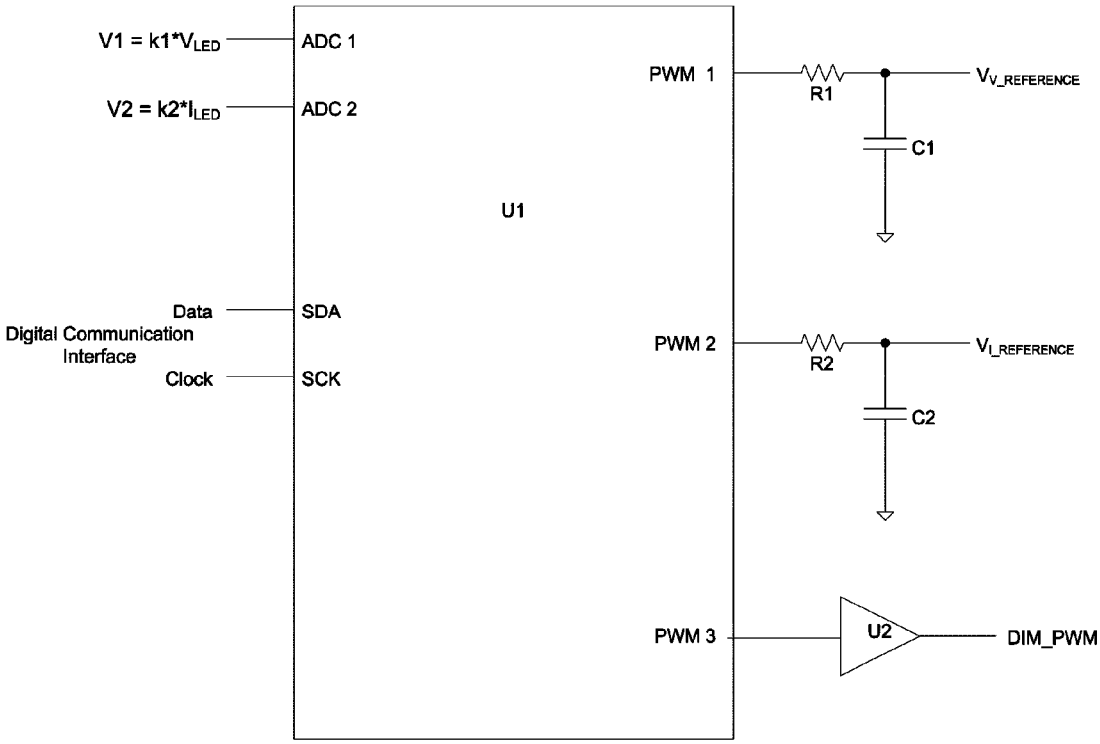
FIG. 9 is schematic diagram showing use of an integrated digital controller used as part of a power control circuit.

FIG. 9 shows dimming control circuitry that can be used to control the switch Q2 of FIG. 8 in a way that can improve the performance of this method of delivering a pulsed current to the lamp. In FIG. 9, U1 is a microcontroller or digital signal processor device with two or more ADC inputs and three or more controllable digital PWM outputs. As shown, two of the PWM outputs are used to generate the voltage and current regulation references $V_{V_REFERENCE}$ and $V_{I_REFERENCE}$. The third PWM is delivered to the input of a driver IC U2 whose output is the DIM_PWM signal that drives the gate of Q2. The ADC inputs are used to monitor signals that are directly proportional to the lamp current and lamp voltage. U1 is a programmable device with a CPU that executes instruction-based routines, for example to set the PWM parameters such as duty cycle and frequency and to process the analog to digital conversions of the voltages applied to the ADC inputs. Using this method of signal processing and creation, it is possible to implement algorithms for improved control over the dimming function which avoid the above drawbacks.

Figure 10:
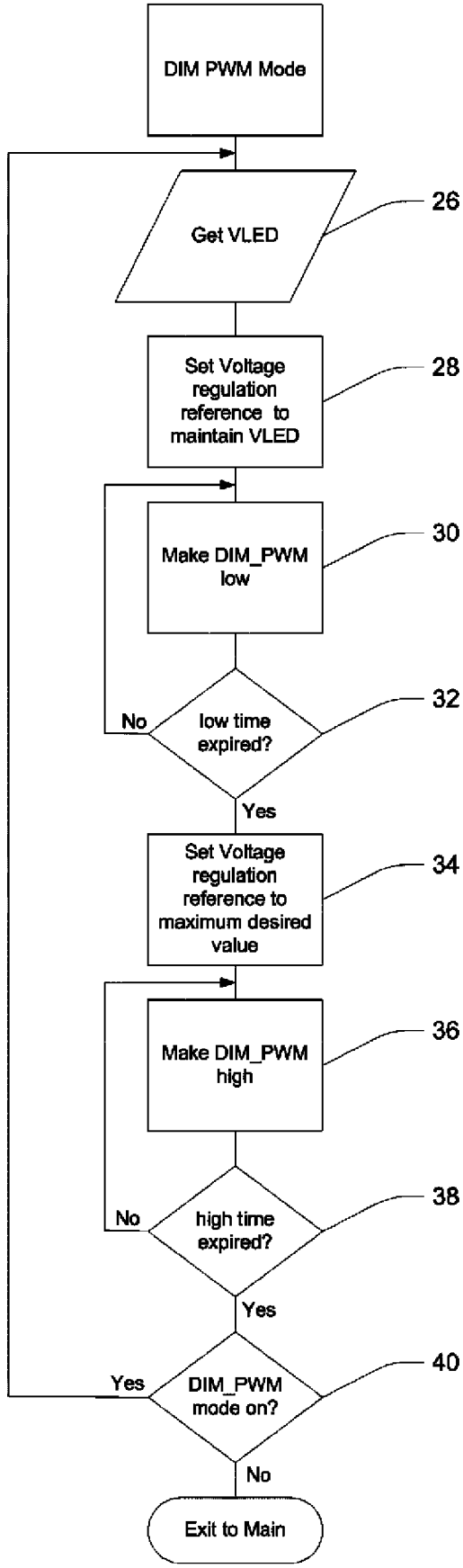
FIG. 10 is a flow diagram of a first technique for avoiding overshoot of lamp current during dimming operation.

FIG. 10 shows a first algorithm or process which synchronizes the delivery of the DIM_PWM signal with the monitoring and setting of the voltage loop reference $V_{V_REFERENCE}$. Under normal operation, a constant undimmed light intensity of the LED lamp is provided by a corresponding constant DC lamp current delivered by the power converter circuitry of FIG. 8. In this normal operating condition, there is a corresponding normal value of the lamp voltage $V_{LED}$, as discussed above. When dimming is required, a dimming mode is enabled (for example by a higher-level controller via the communications interface discussed above with reference to FIG. 1) and the routine of FIG. 10 is initiated. Control of the lamp current may remain in this mode until dimming is disabled or turned off.

Referring to FIG. 10, at 26 the present lamp voltage $V_{LED}$ is read, and at 28 the voltage loop reference $V_{V_REFERENCE}$ is set to the equivalent value that corresponds to the voltage which has been read. It is assumed that at this point the dimming switch Q2 is ON and the lamp voltage $V_{LED}$ is its normal (undimmed) operating value. At 30, the DIM_PWM transitions to its off (or de-asserted) state, which opens the dimming switch Q2 and cuts off lamp current, and by action of the decision block 32 this condition is maintained for a desired OFF period corresponding to the desired level of dimming. During this period, the voltage control loop (FIG. 3) operates to maintain the lamp voltage at the value of $V_{V_REFERENCE}$ which has been set to correspond to the normal operating lamp voltage, so that this normal operating voltage is maintained notwithstanding the normal response of the current control loop to try to increase lamp voltage to increase lamp current back to the normal operating level. Thus, when the DIM_PWM signal transitions back to the on state (step 36), the lamp voltage will be the same value that was present at the time of turning off the dimming switch Q2, so that undesirable overshoot of lamp current is avoided.

As a practical matter, there are generally limitations to the feedback loop response of both the voltage and current control loops that can result in some level of overshoot, generally less than that occurring using the techniques (1) and (2) described above. This overshoot can be minimized somewhat with accurate feedback loop compensation, but at higher pulse train frequencies this method may still result in somewhat imperfect current pulses to the lamp. Even so, this method may significantly improve the characteristic of the pulsed current delivered to the lamp.

Figure 11:
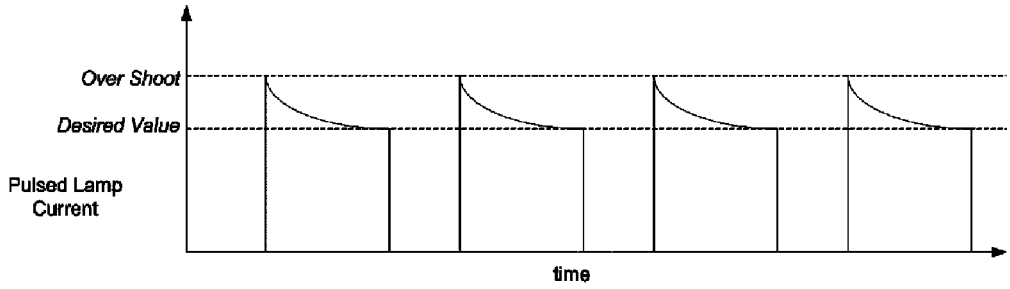
FIG. 11 is a waveform diagram of pulsed lamp current for the first technique of FIG. 10.

FIG. 11 shows an example of pulse current delivered to the lamp with the control algorithm of FIG. 10. This delivered pulse train is the result of using digital control features to modify the behavior of the analog control technique of FIG. 3, as described above with reference to FIG. 10. As shown, there is still some level of overshoot which is a result of the control loop response time, and the amount of overshoot is mostly determined by the loop compensation. Just prior to the on-to-off transition of the dimming switch Q2 (FIG. 8), the current control loop is controlling the CONV_PWM signal to the power interface circuit to maintain the programmed output current. When Q2 is opened, the voltage loop eventually controls the lamp voltage to the desired level, but there is a response time associated with this effect. Until the voltage control loop can properly adjust the PWM value for the power conversion stage, the cycle by cycle energy delivered from T1 will push the lamp voltage to a higher than desired value. With Q2 open and thus no load present across C2, this overshoot may be maximized, and without load the excessive voltage cannot easily bleed down. It is these conditions that cause the overshoot when Q2 is turned back on. When Q2 is on there is load across C2 and the overshoot is brought down until the current settles at the set value.

The waveform in FIG. 11 is an improvement over previous control techniques and will generally result in good light quality during dimming. This is an improvement to the prior art, but there may still be a possibility of excessive overshoot which could damage the LED string. The approach of using the microcontroller circuit (FIG. 9) in conjunction with analog control circuitry (FIG. 3) and a power interface such as in FIG. 8 can be seen as a hybrid implementation using a traditional analog control method with the aid of digital control. Further improvements that converge on a near perfect rectangular current pulse can be achieved if additional digital control is used in replacement of the analog circuitry of FIG. 3.

Figure 12:
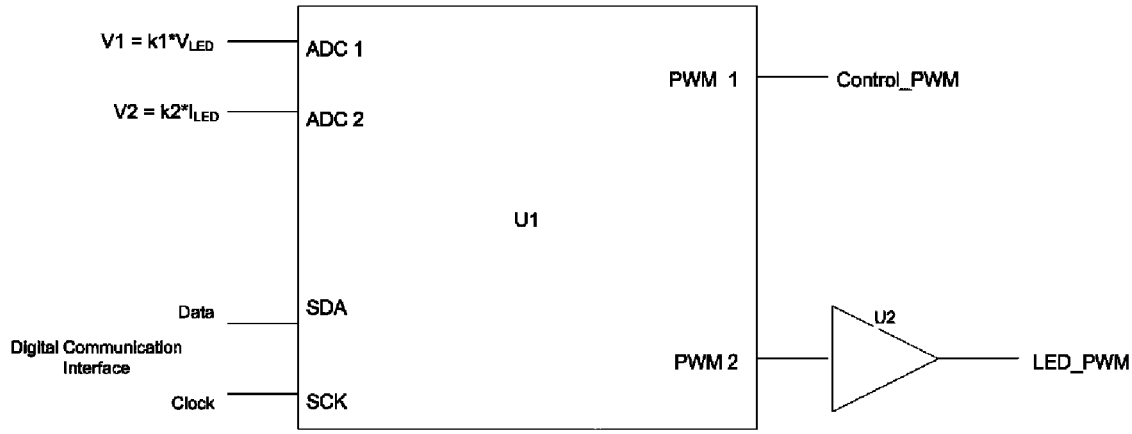
FIG. 12 is a schematic diagram showing use of an integrated digital controller used as part of a power control circuit.

FIG. 12 shows a modification to the digital control circuit that eliminates the generation of the voltage and current reference signals and employs a single converter control signal called Control_PWM. In this implementation, the digital controller U1 might be realized using a digital signal processor (DSP) which has a hardware architecture, instruction set and operating speed necessary to implement more complete digital control. A commercially available example of such a DSP is Microchip DSPIC33FJ64MC204.

Figure 13:
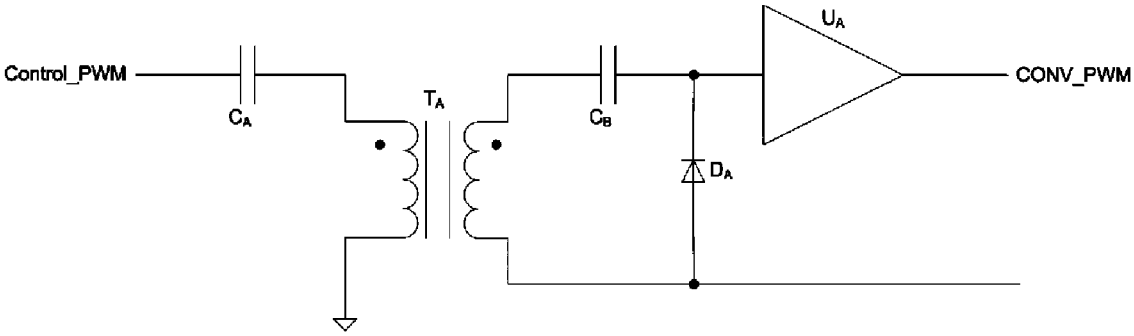
FIG. 13 is a schematic diagram of a circuit for coupling a converter control signal to a primary-side switch from a secondary-side converter control circuit.

FIG. 13 shows a method to couple the Control_PWM signal to ultimately drive the gate of the converter switch Q1 shown in FIG. 8. The circuit in FIG. 13 can be used to create the CONV_PWM signal from the Control_PWM signal when using the control circuit of FIG. 12.

The power conversion circuitry of FIG. 8 derives the VNR voltage from an AC mains and delivers energy to the LED lamp through the coupled inductors T1. The VNR is considered the primary DC voltage or the primary side of the converter stage in FIG. 8. The voltage derived across C2 in FIG. 8 is considered the secondary voltage or the secondary side of the power converter, and T1 provides primary to secondary isolation. The LED lamp is connected to the secondary side. When using an AC mains as the power source, isolation is required in both the control circuits and the power conversion circuits in order to meet safety agency requirements. The coupling transformer labeled TA in FIG. 13 provides this isolation for the control circuitry when secondary referenced digital control is used (as assumed for the circuitry of FIG. 12). With the analog control circuit in FIG. 3, a circuit such as that of FIG. 13 is not required because the circuits which generate the CONV_PWM signal in that case (e.g., U3) are on the primary side of the isolation boundary. In the circuit of FIG. 3 the operational amplifier circuitry is secondary referenced and the resulting analog signals are coupled across the isolation barrier using the opto-coupler U2.

Using circuitry such as in FIGS. 12 and 13, the power interface of FIG. 8 can be directly controlled by the digital control circuitry (U1 in FIG. 12) and the analog control circuitry shown in FIG. 3 is no longer needed. The control functions are implemented digitally with firmware. With firmware control, the PWM signal used to control the converter switch Q1 in FIG. 8 is generated using the DSP instruction set to calculate the PWM value required to control the power delivered to the lamp. The same DSP monitors the lamp current and lamp voltage as control variables. The same DSP uses firmware to create the signal that controls the dimming switch Q2 in FIG. 8. As described above, when analog control circuits such as those of FIG. 3 are used, there is a limitation of response time as a result of compensation components around U1A and U1B. With full digital control, the DSP has direct control over the PWM signals, and firmware can control the state of the signals under different conditions. With firmware control, the time to modify the PWM signals are significantly reduced compared to the analog control method in FIG. 3. For example, DSP firmware could terminate the Control_PWM signal on command.

There are two digital control techniques that can be used to provide closed loop control with a DSP. The first is called a proportional-integral-derivative (PID) loop in which the control parameters are sampled with ADC inputs, multiple samples are stored at even time intervals, and the duty cycle of the Control_PWM output is established by calculations based on these samples. This is a digital implementation of the analog approach using real time calculations to perform the tasks of the discrete compensation components. A second method can be referred to as a seeking loop. In this control method the duty cycle is changed and the resulting output is sampled and compared to a constant value. The Control_PWM value is then modified to move the desired control variable towards its desired value. This is done continuously, making PWM adjustments as needed to keep the controlled output at the desired value. In the analog world this is similar to hysteretic control. Regardless of the control algorithm selected, one advantage of the full digital control is the ability to have the firmware override the control algorithm and set the Control_PWM to any value under a defined condition. Commanding a Control_PWM value in this method can also be synchronized with other events controlled or monitored by the DSP. This allows implementation of an alternative to the algorithm of FIG. 10, which is described below with reference to FIG. 14.

As previously noted, the power interface in FIG. 8 is that of a flyback converter. There are two implementations of this topology that are a function of how the transformer or coupled inductors, T1, is designed. These implementations are commonly referred to as discontinuous and continuous operation.

In the circuit of FIG. 8, when Q1 is on then the VNR voltage is applied across the primary of T1 and energy is added to the magnetizing inductance. In discontinuous operation, all of this stored energy is transferred to the load through diode D1 during the time that Q1 is off. In continuous operation, there is always excess energy stored in the transformer's magnetizing inductance that is not delivered to the load during the off time for Q1. If the transformer is designed for discontinuous operation, then when a PWM pulse is terminated at the completion of a full cycle there will be no energy in the transformer to deliver to the load.

Figure 14:
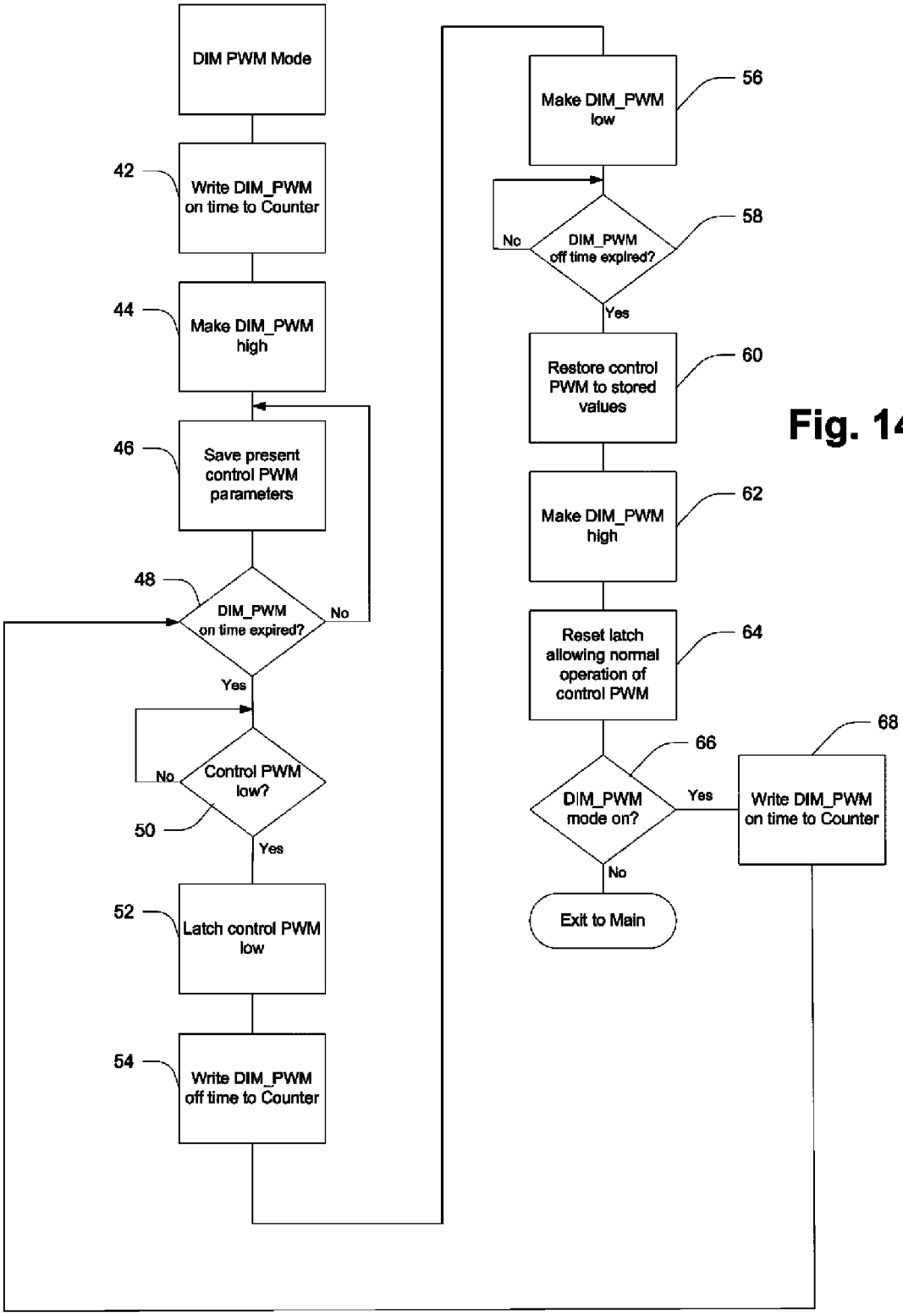
FIG. 14 is a flow diagram of a second technique for avoiding overshoot of lamp current during dimming operation.

FIG. 14 illustrates a technique that can be used in pulsed current mode to take advantage of discontinuous operation to optimize the pulse current delivered to the lamp. The process of FIG. 14 includes a number of steps labeled 42 through 68. A key element in this control algorithm is stopping the Control_PWM pulses before opening the dimming switch Q2, which is described specifically be steps 50 to 60. By this technique, when Q2 is opened then no additional energy is delivered to C2 and when the LED load is removed this capacitor will be essentially open circuit and will maintain the voltage that was present when Q2 was closed. Now firmware can reestablish the Control_PWM just prior to closing the dimming switch Q2 resulting in a very clean rectangular pulse of current delivered to the lamp. Another advantage is the ability to use memory contained in the DSP to learn the operating characteristics of the lamp under different conditions that can monitored with the ADC inputs on the DSP. For example an input can be added that monitors temperature, and then if needed decisions can be made to tailor this algorithm based on present operating temperature. So as operating conditions are stored it can be assured that the correct value of Control_PWM is being restored every time Q2 closed.

The process of FIG. 14 includes steps 46 and 60 of saving and restoring the PWM operating parameters of the converter control circuitry, prior to the modifying of operation of this circuitry at step 52 and the resumption of normal operation at step 64.

In LED lamps, there is the possibility of light flickering and even damage when power is first applied ("turn-on") if accompanied by an overshoot. firmware in the power control circuitry may control the voltage and current reference values in a certain manner to avoid these problems, as well as to provide a visually pleasing soft start.

A turn-on process may be performed as follows:

1. When power is applied or when the outputs are commanded on, delay for about 200 ms to allow for capacitor discharge in the event of a quick power cycle.
2. Ramp up the current reference to a low value (about 20 mA) in about 100 ms.
3. Ramp up the voltage reference fairly quickly (about 50 ms) until the LEDs begin to draw current (about 8 mA).
4. Ramp up the voltage reference fairly slowly (about 200 ms) until the LEDs draw the desired low current (about 20 mA).
5. Ramp up the voltage reference fairly quickly (about 50 ms) until the reference voltage is at the maximum desired value (about 120V).
6. Ramp up the current reference to the final desired value (about 750 mA). The slope of this ramp is selected to provide the desired turn-on time (from about 100 ms to a minute).

Figure 15:
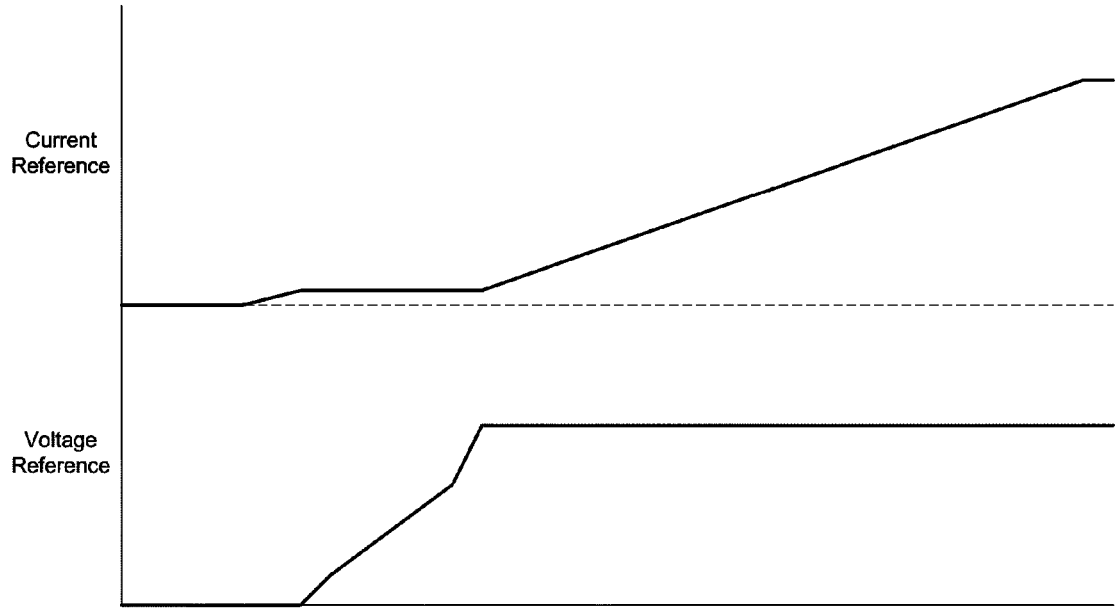
FIGS. 15 and 16 show examples of the values of current and voltage references during turn-on and turn-off processes.

FIG. 15 shows an example of the values of the current and voltage references during the above turn-on process.

To prevent light flickering at turn-off that can occur when only the current reference is reduced, a similar technique may be utilized:

1. Ramp down the current reference to a low value (about 20 mA). The slope of this ramp is selected to provide the desired turn-off time (from about 100 ms to a minute).
2. Ramp down the voltage reference to 0 fairly quickly (about 50 ms).
3. Set the current reference to 0.

Figure 16:
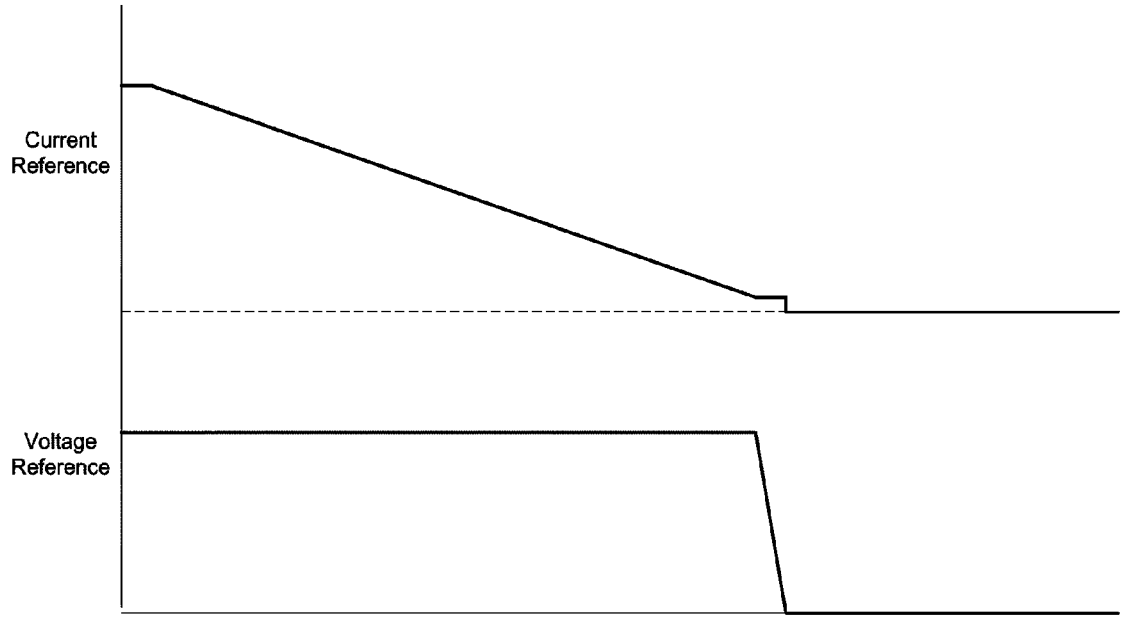

FIG. 16 shows an example of the values of the current and voltage references during the above turn-off process.

When ramping up or down the voltage reference, it important to change the PWM duty cycle by small increments (e.g., one bit at a time). If the duty cycle is changed too rapidly, it can cause the output voltage to overshoot which produces light flickering.

In an LED ballast the addition of a digital interface for the purpose of monitoring and configuration allows for a very flexible solution. When adding a digital interface it is possible to implement all of the control functions including this interface with a single DSP device and small amount of peripheral components reducing size and cost. In addition significant performance improvements can be achieved if a pulsed current dimming mode is needed. Other enhancements include accurate setting of operating parameters with calibration and adaptive modes of operation as a function of monitored parameters.

Additional items that can be monitored and used in control processes include:

1) Temperature, by addition of simple temperature transducers both remotely at the lamp and within the ballast itself.
2) Ambient light, with an optical transducer interfaced to the DSP.
3) Input and output power conditions.

From a communications and control standpoint true digital control greatly simplifies the circuitry required to implement a communications protocol with a rich set of functionality. The ease of implementing these features around true digital control makes this approach even more attractive. The attached communications protocol has been developed by Bel and has been successfully implemented in a digital control version of an LED ballast.

True digital control architecture for the control and regulation features of a LED lighting power supply provides a rich feature set without adding significantly to the cost of implementation. Modern DSPs include features that allow these features to be enabled with the use of specific control algorithms. This method also allows control algorithms to be implemented that greatly enhance the performance when delivering a pulsed load current to the lamp. Being a programmable solution the DSP implementation makes calibration and adaptive operation possible without adding to the hardware cost.

As mentioned above, the circuits of FIGS. 2 and 8 are so-called "flyback" converters, but other power conversion topologies can be used. The control technique described herein generally assume the presence of primary-side power circuitry (such as coil 22 and switch Q1) and secondary-side power circuitry (such as coil 24 and switch Q2).

While various embodiments of the invention have been particularly shown and described, it will be understood by those skilled in the art that various changes in form and details may be made therein without departing from the spirit and scope of the invention as defined by the appended claims.

What is claimed is:

1. A power supply for an LED lamp having a plurality of series-connected high-power light-emitting diodes, comprising:

primary-side power circuitry including a converter power switch in series with a primary-side coil for conducting input power based on a converter control signal supplied to the converter power switch;

secondary-side power circuitry including a dimming power switch in series with the LED lamp and a secondary-side coil inductively coupled to the primary-side coil for providing output power to the LED lamp based on a dimming control signal supplied to the dimming power switch; and power control circuitry including:

(1) converter control circuitry having a normal operation by which it generates the converter control signal to maintain a desired undimmed level of lamp current in the LED lamp at a normal operating value of a lamp voltage of the LED lamp, the normal operation including an automatic increasing of the lamp voltage in response to a decrease in lamp current; and (2) dimming control circuitry operative to generate the dimming control signal to pulse-width modulate the lamp current at a duty cycle corresponding to a desired dimming of the LED lamp, and (a) at on-to-off transitions of the dimming control signal, to modify operation of the converter control circuitry to prevent the automatic increasing of the lamp voltage in response to a decrease in lamp current, and (b) at off-to-on transitions of the dimming control signal, to restore normal operation of the converter control circuitry.

2. A power supply according to claim 1, wherein the converter control circuitry includes (a) a comparator operative to compare a current feedback signal from the LED lamp to a current reference signal corresponding to the desired undimmed level of lamp current in the LED lamp, and (b) a PWM control circuit operative to convert a difference output from the comparator to a corresponding value of either a duty cycle or frequency of the converter control signal.

3. A power supply according to claim 2, wherein:

the comparator is a first comparator and assertion of the difference output reduces the value of the duty cycle and frequency of the converter control signal;

the converter control circuitry further includes a second comparator operative to compare a voltage feedback signal from the LED lamp to a voltage reference signal corresponding to a predetermined maximum level of lamp voltage on the LED lamp; and respective outputs of the first and second comparators are coupled together to permit either comparator to independently reduce the level of the timing aspect of the converter control signal.

4. A power supply according to claim 3, wherein the power control circuitry includes a reference generator circuit operative to generate the voltage reference signal by (a) generating a reference PWM signal having a duty cycle corresponding to a desired value of the voltage reference signal, and (b) filtering the reference PWM signal to generate a corresponding DC value of the voltage reference signal.

5. A power supply according to claim 2, wherein the power control circuitry includes a reference generator circuit operative to generate the current reference signal by (a) generating a reference PWM signal having a duty cycle corresponding to a desired value of the current reference signal, and (b) filtering the reference PWM signal to generate a corresponding DC value of the current reference signal.

6. A power supply according to claim 1, wherein:

the converter control signal is generated so as to establish an on value of the lamp voltage which (a) maintains the desired undimmed level of lamp current in the LED lamp during non-dimmed operation, and (b) is less than a predetermined maximum lamp voltage represented by a first value of a voltage reference signal;

the dimming control circuitry is further operative, during on times of the dimming control signal, to store the on value of the lamp voltage;

modifying operation of the converter control circuitry includes, immediately prior to the on-to-off transitions of the dimming control signal, setting the voltage reference signal to a second value representing the stored on value of the lamp voltage; and restoring normal operation of the converter control circuitry includes, immediately prior to the off-to-on transitions of the dimming control signal, returning the voltage reference signal to the first value.

7. A power supply according to claim 6, wherein the power control circuitry is partly embodied in a digital controller including analog-to-digital converters, a processor, and a PWM output, the analog-to-digital converters being operative to convert analog inputs representing the lamp voltage and the lamp current to corresponding digital values for processing by the processor, the PWM output carrying a reference PWM signal having a duty cycle corresponding to a present value of the voltage reference signal.

8. A power supply according to claim 1, wherein the power control circuitry is implemented substantially as an integrated digital controller programmed with respective control routines to realize the converter control circuitry and the dimming control circuitry, a dimming control routine including:

at the on-to-off transitions of the dimming control signal, (a) waiting as necessary until the converter control signal becomes off, and (b) latching the converter control signal to prevent it from becoming on during off times of the dimming control signal; and at the off-to-on transitions of the dimming control signal, un-latching the converter control signal to allow resumption of normal operation of the converter control circuitry.

9. A power supply according to claim 8, wherein the dimming control routine further includes:

during the normal operation, saving present operating parameters of the converter control circuitry; and on the off-to-on transitions of the dimming control signal, restoring the saved operating parameters to the converter control circuitry.

10. A power supply according to claim 8, wherein the secondary-side power circuitry includes a filter capacitor effective to store a constant secondary-side voltage while the converter control signal is latched in the off state, the secondary-side voltage being applied to the LED lamp during a succeeding on time of the dimming control signal.

11. A power supply according to claim 1, further including rectification circuitry operative to generate substantially unregulated intermediate DC power from AC power supplied as input power to the power supply, and wherein the primary-side power circuitry is coupled to an output of the rectification circuitry to conduct the unregulated intermediate DC power as the input power to the primary-side power circuitry.

12. A power supply according to claim 1, wherein the dimming control signal is operative in response to a dimming control input from a higher-level controller in a lighting system which includes the power supply and the LED lamp.

13. A power supply according to claim 12, wherein the power control circuitry is implemented at least partly by an integrated digital controller having a digital communications interface coupled to the higher-level controller, and wherein the dimming control input is a digital control message received by the integrated digital controller via the digital communications interface.

14. A power supply according to claim 13, being packaged in a housing having (a) first wires for connection to an external source of AC power, (b) second wires for connection to the LED lamp, and (3) third wires for connection to the higher-level controller.

15. A power supply according to claim 1, wherein the power control circuitry is operative to perform either or both of a turn-on process and a turn-off process, the turn-on process being performed when power is first applied or power outputs are commanded on and including:

delaying for a first period to allow for capacitor discharge in the case of quick power cycling;

ramping up a current reference to a first low value over a first interval;

ramping up a voltage reference over a second interval until the light-emitting diodes begin to draw current;

ramping up the voltage reference slowly until the light-emitting diodes draw a desired low current;

ramping up the voltage reference quickly until the reference voltage is at a value corresponding to a maximum desired value of the lamp voltage; and ramping up the current reference to a final desired value over a period selected to provide a desired overall turn-on time;

and the turn-off process being performed when power is being removed or power outputs are commanded off and including:

ramping down the current reference to a low value over a period selected to provide a desired overall turn-off time;

ramping down the voltage reference to 0 quickly; and setting the current reference to zero.

* * * * *